US005503702A

United States Patent [19]

Filicicchia et al.

[11] Patent Number: 5,503,702

[45] Date of Patent: Apr. 2, 1996

[54] HIGH SPEED LABELER

[75] Inventors: David D. Filicicchia, Schaumburg; Kenneth L. Guenther, Park Ridge; David Haas, Schaumburg; Joseph Kalika, Niles; Raymond W. Lee, Chicago; K. George Rabindran, Morton Grove; Gary L. VanderSyde, Naperville, all of Ill.

[73] Assignee: Bell & Howell Company, Skokie, Ill.

[21] Appl. No.: 203,814

[22] Filed: Mar. 1, 1994

[51] Int. Cl.[6] ..... B44C 1/10

[52] U.S. Cl. ..... 156/249; 156/358; 156/361; 156/541; 156/542; 156/DIG. 37; 156/DIG. 38; 156/DIG. 42; 156/DIG. 45

[58] Field of Search ..... 156/541, 542, 156/540, 249, 358, 361, DIG. 37, DIG. 38, DIG. 42, DIG. 45

[56] References Cited

U.S. PATENT DOCUMENTS

| | | | |
|---|---|---|---|
| 3,261,464 | 7/1966 | Levy . | |
| 3,396,505 | 8/1968 | McCrudden . | |
| 3,573,748 | 4/1971 | Holme . | |
| 3,729,362 | 4/1973 | French et al. . | |
| 3,769,139 | 10/1973 | Woods | 156/541 X |
| 3,984,277 | 10/1976 | French et al. . | |
| 4,080,239 | 3/1978 | Real et al. | 156/542 X |
| 4,250,690 | 2/1981 | Lorenzen et al. . | |
| 4,310,276 | 1/1982 | Castagnoli . | |
| 4,314,644 | 2/1982 | Stocker . | |
| 4,547,252 | 10/1985 | LaMers . | |
| 4,581,094 | 4/1986 | Sato | 156/542 X |
| 4,585,506 | 4/1986 | Matsuguchi | 156/542 X |
| 4,612,079 | 9/1986 | Ostrow | 156/542 X |
| 4,624,734 | 11/1986 | Voltmer et al. | 156/542 X |
| 4,676,859 | 6/1987 | Cleary, Jr. et al. . | |
| 4,787,953 | 11/1988 | Trouteaud et al. | 156/542 X |
| 4,853,063 | 8/1989 | Basgil et al. | 156/542 X |
| 5,076,879 | 12/1991 | Svyatsky | 156/541 X |
| 5,149,392 | 9/1992 | Plaessman | 156/542 |
| 5,188,696 | 2/1993 | Good, Jr. | 156/542 X |
| 5,232,540 | 8/1993 | Southwell et al. | 156/542 X |
| 5,254,206 | 10/1993 | Wing | 156/542 |

*Primary Examiner*—Mark A. Osele
*Attorney, Agent, or Firm*—Welsh & Katz, Ltd.

[57] ABSTRACT

A labeling assembly for applying labels carried on a substrate to a sequential series of moving documents is provided. The assembly transports the document in a generally vertical end on end orientation down a conveying path and peels the label from the substrate to position the peeled label in a generally vertical orientation. The labeling assembly also includes a paddle having a front surface with vacuum ports for attaching and releasably retaining the peeled label on the front surface. An actuating mechanism pivots the paddle to force an end of the retained label into contact with the document. Upon contact, the downstream end of the retained label adheres to the document and the label is pulled off the paddle. As the label is pulled off the paddle the contact between the end of the paddle presses the label against the document.

19 Claims, 5 Drawing Sheets

HIGH SPEED LABELER

FIELD OF THE INVENTION

This invention relates to automatic labeling systems for applying labels to surfaces and more particularly to automatic labeling systems which apply labels to the surfaces of envelopes passing through a mail sorting apparatus.

BACKGROUND OF THE INVENTION

In many situations, labels must be adhesively attached to surfaces of articles which are moving in an assembly-line fashion. The labels are typically fashioned with an adhesive surface which is attached to a backing strip from which the labels are removed. The labeling of the articles is carried out by a label application device which first removes the labels from the backing strip to expose the adhesive surface and then applies the labels to the surfaces of the articles as the articles move past the label applicator.

In mail sorting situations, there are many occasions where labels must be applied to envelopes as the envelopes move along a conveying path through a mail sorting apparatus. One occasion is when the envelope must be supplied with a label on which a bar code will be applied. The bar code then is read to sort the envelope at a location downstream from the labeling station. Typically, mail handling devices have a very high rate of mail throughput which translates to a large number of envelopes moving very quickly along the conveying path of the mail handling apparatus.

In labeling devices, it is known to use a peeling bar to remove the labels from the backing strip. The backing strip carrying the label is tautly pulled across the peeling bar which causes the label to separate from the substrate. The peeled label is then retained against a surface of an applicator by suction or vacuum pressure to expose the adhesive surface. An article onto which the label is to be applied is then momentarily held in close proximity to the label holding surface. The label may be applied to the article by use of a blast of air to force the label against the article. Alternately, the holding surface is linearly advanced toward the article and the label is applied by contact between the article and the holding surface.

This attaching arrangement and method may work for many applications, particularly when the article may be momentarily held in the application location. However, in the mail handling apparatus where large numbers of envelopes or other articles are moving very quickly along the conveying path and even momentary retention is not feasible, use of these devices have significant drawbacks. For example, using a blast of air to apply the label may cause an upstream edge of the label to initially contact the envelope. Because the envelope is rapidly moving, the label will wrinkle before the other portions of the label contact the surface of the envelope.

Also, in both the air applicator and linearly moving surface, if the holding surface and envelope surface do not correspond, the problem of wrinkling may also occur. This correspondence is rare in mail handling as the envelopes may contain contents having varying thicknesses and configurations. In addition, the forces required to linearly reciprocate the mass of the moving applicator may preclude use of this type of device in a mail handling situation where the number of reciprocations is very high.

It is therefore an object of the present invention to provide a labeling system for applying labels to moving surfaces, and more particularly a labeling system for a mail handling apparatus.

It is another object of the present invention to provide a labeling system which may apply to moving surfaces, labels which are carried on a backing substrate.

It is a further object of the present invention to provide a labeling system which may apply labels to moving surfaces in a manner which reduces wrinkling.

A still further object of the present invention is to provide a labeling assembly which may apply labels to envelopes and other documents in high volume, high throughput sorting equipment.

SUMMARY OF THE INVENTION

Accordingly, a labeling assembly for applying labels carried on a substrate to a sequential series of moving envelopes is provided. The assembly transports the envelope in a generally vertical end on end orientation down a conveying path and peels the label from the substrate to position the peeled label in a generally vertical orientation. The labeling assembly also includes a paddle having a front surface with vacuum ports for attaching and releasably retaining the peeled label on the front surface. An actuating mechanism pivots the paddle to force an end of the retained label into contact with the envelope. Upon contact between the label and envelope, the downstream end of the retained label adheres to the envelope and the label is pulled off the paddle. As the label is pulled off the paddle, the contact between the end of the paddle presses the label against the envelope.

In addition, a control system may be operatively connected to a drive mechanism for pulling the substrate over the peeling edge to peelingly remove one of the labels from the substrate when the envelope passes a first predetermined location along the conveying path. Also, the control system maybe connected to the actuating mechanism to pivot the paddle when the envelope passes a second predetermined location along the conveying path.

DESCRIPTION OF THE PREFERRED EMBODIMENTS

Figure 1:
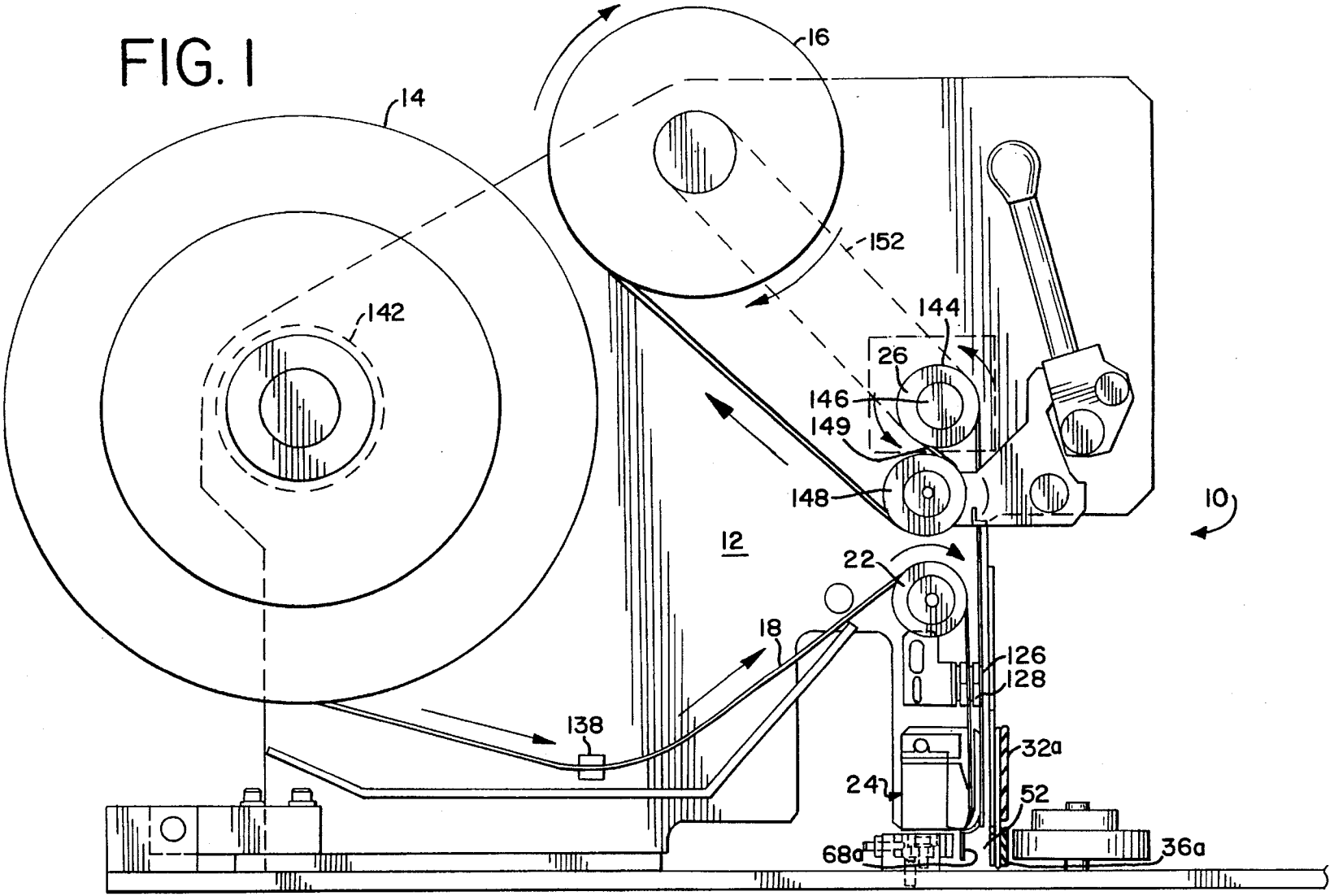
FIG. 1 is a side elevation view of the high speed labeler assembly constructed in accordance with the teachings of the present invention.
Figure 3:
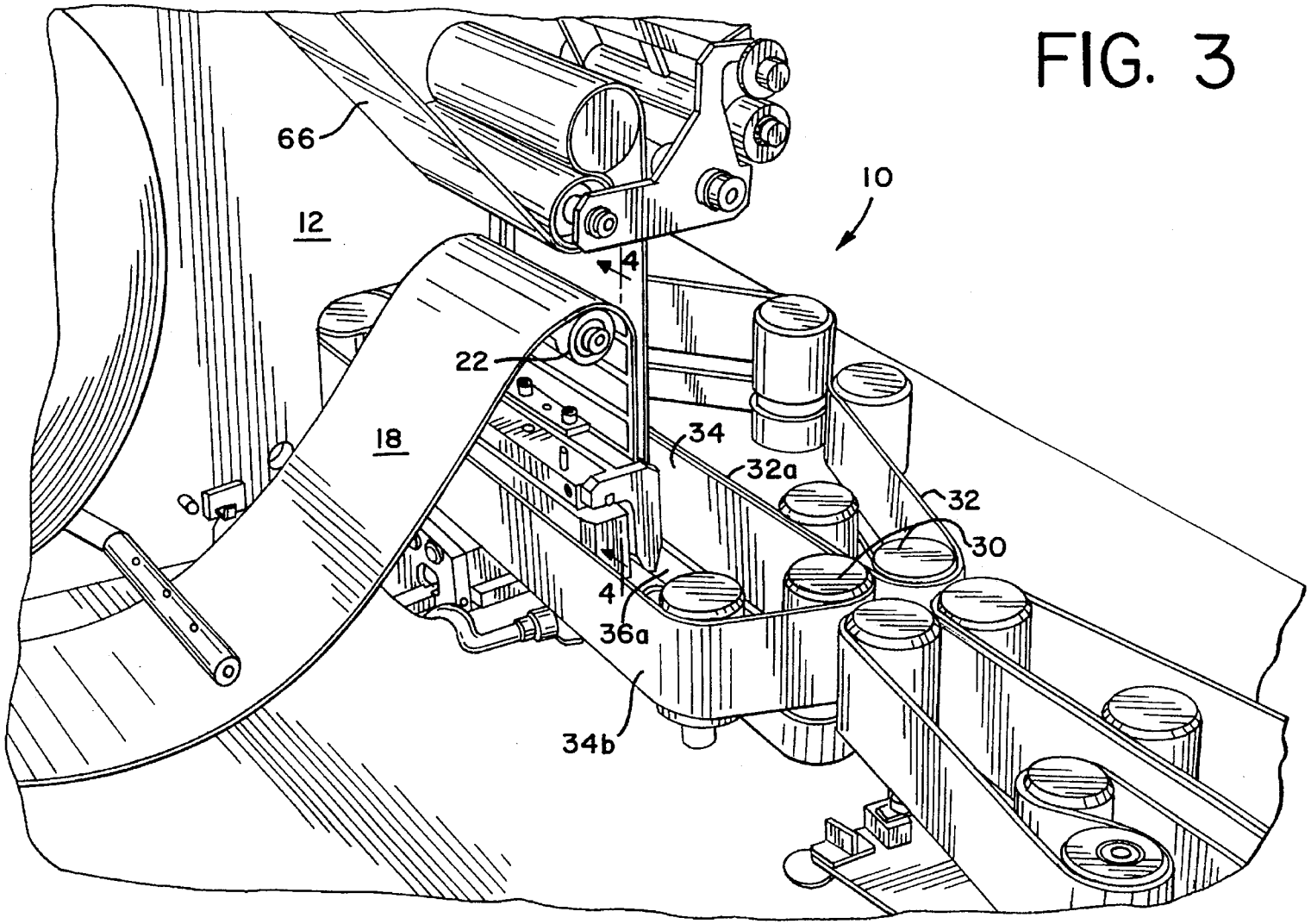
FIG. 3 is a perspective view illustrating the manner of operation of the high speed labeler assembly of the present invention.

Referring now to the drawings, and in particular to FIGS. 1 and 3, a high speed labeler assembly constructed in accordance with the present invention is indicated generally at 10. The labeler system 10 may form a portion of a larger system for addressing and/or sorting flat documents, such as postal envelopes, letters and the like. The addressing system may also include a feeder station (not shown) from which documents 11 (shown in FIGS. 1 and 4) are sequentially fed in a vertical, edge on edge, orientation to a reader station (not shown). The reader station may include an optical character reader to scan the document 11 for an I.D. tag. The high speed labeler system 10 may then label the document 11 with a label along the vertical surface of the document. The document is then transported to a bar code printer station (not shown) which prints the bar code on the applied label and the document may then continue on to stacking stations where, in dependence on the information contained within the bar code, the document is sorted into the appropriate stack.

The labeling system 10 includes a vertically oriented supporting structure 12 upon which a supply reel 14 and take-up reel 16 are rotatably mounted. An elongated strip 18 of labels is wound on the supply reel 14 and extends over a guide roller 22; through a label applicator assembly, generally indicated at 24; through a drive station 26, to the take-up reel 16. The labeling system 10 is disposed along a section of a document conveying path 28 (FIG. 2) which is defined by document conveying means 30 such as the inner reaches 32*a* and 34*a* of a pair of endless upper conveying belts 32 and 34 respectively. The document conveying means 30 also includes means for elastically supporting and positioning the lower edge portion of the document 11, such as inner reach 36*a* of lower conveying belt 36, as the document travels down the conveying path 28 adjacent the labeler applicator 24.

Figure 2:
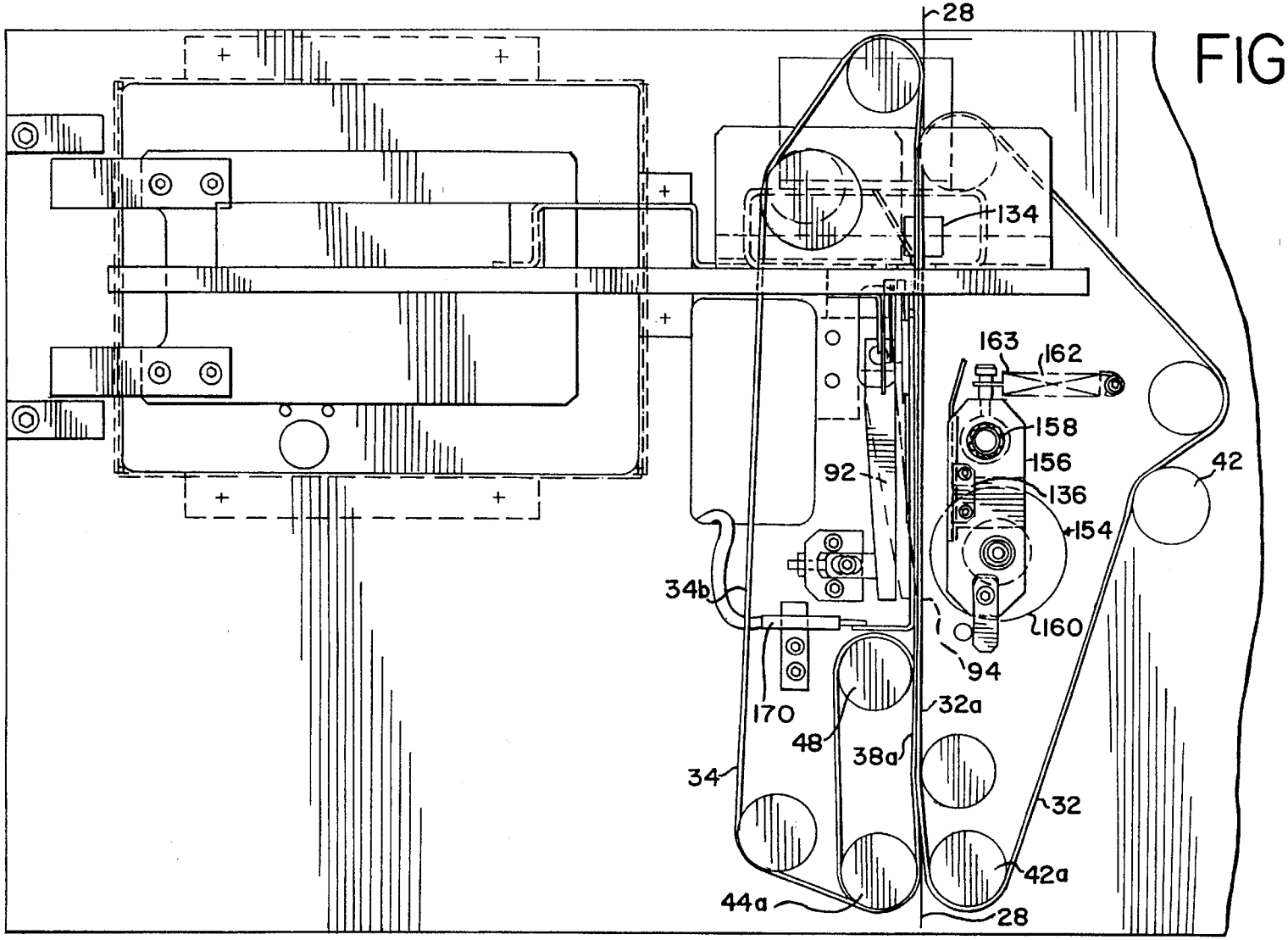
FIG. 2 is a top elevation view of the high speed labeler assembly of FIG. 1.

Referring to FIGS. 2 and 3, the upper conveying belt 32 and lower conveying belt 36, which are oppositely disposed along the conveying path 28 from the labeler 10, are supported by a number of vertical axis rotatable rollers 42, with one roller such as 42*a* being rotatably driven to cause controlled linear movement of the inner reaches 32*a* and 36*a* of the upper conveying belt and lower conveying belt respectively along the conveying path.

The upper conveying belt 34 along the conveying path 28 adjacent the labeler 10 is supported by a number of vertical axis rotatable rollers 44 with one roller of the number such as 44*a*, being rotatably driven. The rotatable rollers 44 are disposed so that the label applicator 24 downwardly depends between the inner reach 34*a* and outer reach 34*b* of the upper conveying belt 34.

A lower belt 38 adjacent the labeler 10 extends about drive roller 44*a* and intermediate vertical axis rotatable roller 48 to establish a vertical inner conveyer belt reach 38*a*. The inner reach 34*a* of the adjacent lower belt 34 lies in juxtaposing relation with the inner reach 36*a* of the opposite lower belt 36. However, the inner reach 38*a* extends along only a portion of the inner reach 36*a* of the opposite lower belt 36 to form a passageway 52 through which labels are applied, in a manner described more fully below, to the documents 11 (FIG. 4) traveling along the conveying path 28. The drive roller 44*a* causes controlled linear movement of the inner reaches 34*a* and 38*a* of the upper belt 34 and lower belt 38 along the conveying path 28 preferably at a speed equal to the linear movement of inner reaches 32*a* and 36*a*.

Figure 4:
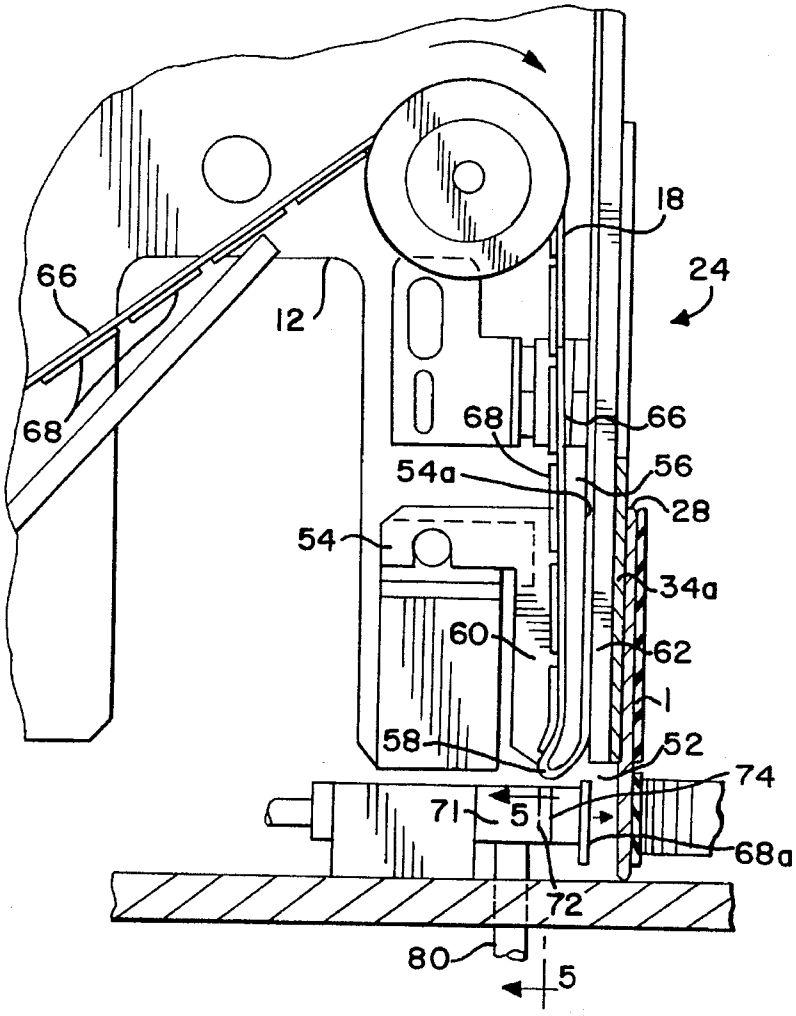
FIG. 4 is a partial side elevation view of the high speed labeler assembly of FIG. 1.

Referring to FIGS. 2 and 4, the label applicator assembly 24 includes a vertically extending support bar 54 which is rigidly attached to the supporting structure 12. A vertically extending peeler bar 56 has a lower horizontally extending peeling edge 58 with the peeling edge also extending generally parallel to the conveying path 28. The peeler bar 56 is rigidly attached to the support bar 54 and supporting structure 12 and is spaced from the support bar to provide a pathway 60 for the downward feeding of the elongated strip 18.

A planar guide plate 62 generally parallel to the conveying path 28 extends along the forward face 54*a* of the peeler bar 54 and is separated from the peeler bar to provide a pathway for the upward feeding of the strip 18 from the peeler bar 56. The guide plate 62 also prevents the adjacent upper belt 34 from coming into contact with the strip 18.

The elongated strip 18 includes a substrate 66 of release paper and a plurality of labels 68 which are adhered to the substrate. Within the applicator 24, the strip 18 is threaded downward through the pathway 60 so that the labels face the support bar 54. The strip 18 then passes around the peeling edge 58 where the strip is bent sharply so that a label such as 68*a* is removed from the substrate 66 as the strip is pulled across the peeling edge. The substrate 66 then continues upward through passageway 64 to the drive station 26 while the peeled label 68*a* (FIG. 1) extends generally vertically downward from the peeler bar 54 with the now exposed adhesive side of the label facing the opening 52 and conveying path 28. In this manner, each label 68 is sequentially removed from the substrate 66 as the substrate is intermittently fed around the peeler 56.

Figure 5:
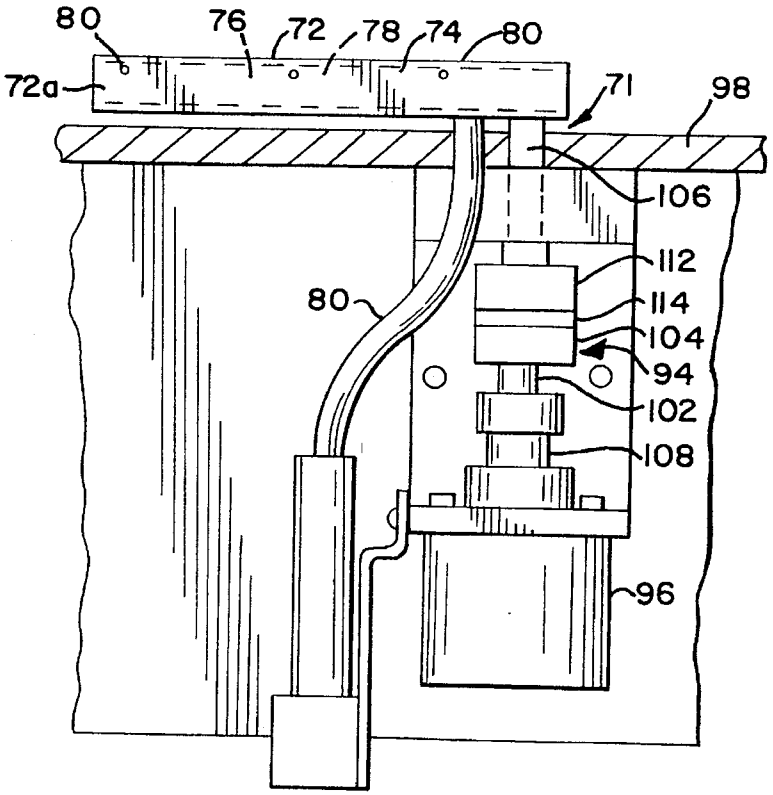
FIG. 5 is a detail front elevation view of the high speed labeler assembly taken along the line 5—5 in FIG. 4.

Situated beneath the peeler 56 is a device 71 for releasably retaining the peeled label 68*a* and applying the label to a document 11 travelling down the conveying path 28. The device 71 includes a vacuum head in the form of a paddle 72. Referring to FIGS. 4 and 5, the paddle 72 has a flat vertically extending front face 74 which, when the paddle 72 is in the loading position as shown in FIG. 4, is disposed below and is vertically aligned with the peeling edge 58. The paddle 72 is preferably constructed of a light metal such as aluminum, and the front face 74 may be fashioned with a smooth surface to reduce any friction between the front face and the retained label.

The paddle 72 forms a hollow interior 76 which comprises a vacuum chamber 78. A series of ports 80, preferably three, are spaced along the front face 74 of the paddle 72 and in close proximity to the upper edge of the front face. The ports 80 communicate between the front face 74 of the paddle 72 and the vacuum chamber 78, and provide a means for releasably retaining the peeled label 68*a* on the front face 74 of the paddle 72. The vacuum pressure is transmitted from a vacuum source (not shown) to the vacuum chamber 86 through sealable hosing 88 connected to the underside of the paddle 72.

The label retaining and applying device 71 also includes a means for pivoting the paddle arm from the loading position to an applicating position 92 as shown in shadow in FIG. 2. In the applicating position 92, an outer portion 94 of the front face 74 extends into the conveying path so that the adhesive surface of the label 68*a* (FIG. 1) being retained on the paddle 72 contacts the document 11 as the document 11 travels down the conveying path.

The pivoting movement is provided by operatively connecting the paddle 72 to an actuating mechanism 94. The actuating mechanism 94 includes a motor drive 96 which is mounted below the surface 98 of the sorting system. The motor drive 96 includes a shaft 102 which extends upward into a vertical clutching mechanism 104. An activating shaft 106 is connected to the upper portion of the clutching mechanism 104 and extends upward through the surface 98 where the shaft is rigidly attached to the paddle 72. The clutching mechanism 104 provides a means whereby the activating shaft 106 may move vertically a short distance relative to the motor shaft 102 and yet rotational movement of the motor shaft 102 causes a corresponding rotation of the activating shaft.

The actuating mechanism 94 has a spring 108 which unless the motor drive is actuated, rotates the motor shaft 102 and thus the actuating shaft 106 and the paddle 72 back into the loading position from the applicating position. The actuating mechanism 94 also includes a solenoid 112 which is connected to the upper portion of the clutching mechanism 104. When actuated, the solenoid 112 causes a short downward movement of the activating shaft 106 and paddle 72. A spring 114 contacts the clutching mechanism 104 so that when the solenoid 112 is not actuated, the biasing force of the spring returns the activating shaft 106 and paddle to the upper position.

The high speed labeler 10 also includes a control circuit 122 which advances the elongated strip 18 so that the label 68*a* is properly positioned on the front face 74 of the paddle 72 and the actuating mechanism 94 is activated to pivot the paddle to the applicating position 92 at the proper moment when the document 11 is adjacent the labeler 10. The control circuit 122 (FIG. 6) includes a central processing unit which may be of any appropriate configuration.

Figure 6:
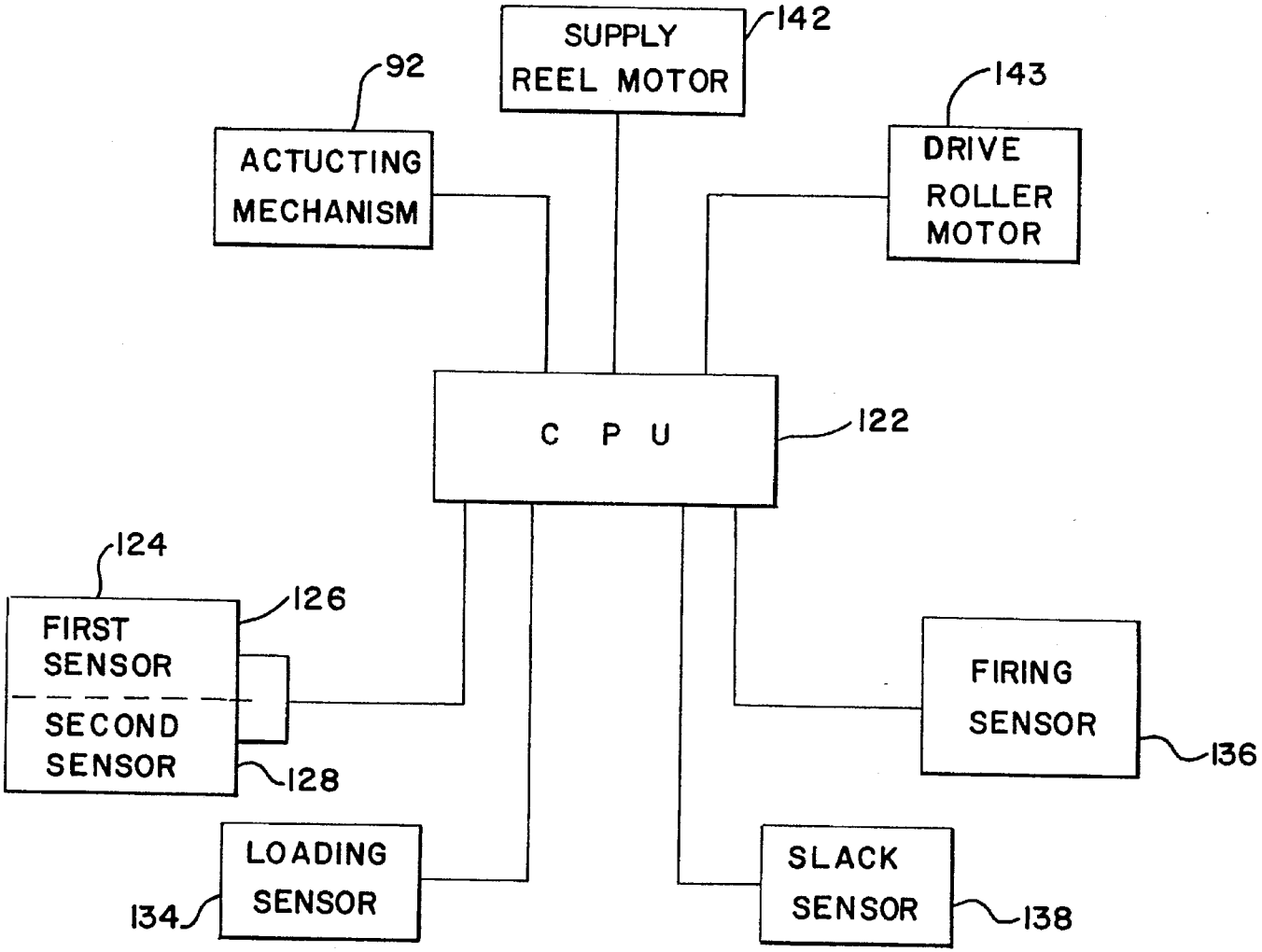
FIG. 6 is a schematic diagram of the control circuit for controlling the operation of the high speed labeler assembly of the present invention.

The control circuit 122, as shown in FIG. 6, is operatively connected to a first sensor means 124 which determines the position of the labels 68 on the substrate 66. Referring to FIG. 1, the first sensor means 124 includes a first sensor 126 and a second sensor 128 both of which are mounted to the supporting structure 16 adjacent the upper edge of the peeler bar 56. The first and second sensors 126 and 128 are positioned so that the elongated strip 18 extends downward through the sensors before extending downward through the pathway 60. The first sensor 126 is disposed so that it senses the edge of the elongated strip 18 where labels 68 typically do not extend.

In contrast, the second sensor 128 is disposed so that as the elongated strip 18 advances, the second sensor senses either the substrate 66 or the label 68 attached to the substrate 66. By contrasting the reading of the first sensor 126 with the second sensor 128, the control circuit 122 determines when a label reaches the first sensor 126; and therefore, when the leading edge 132 of the label 68 is adjacent the second sensor 128.

Referring to FIGS. 1, 4 and 6, the control circuit 122 is also operatively connected to a loading sensor 134 which is disposed along the conveying path upstream of the labeler 10. The position of the loading sensor 134 relative to the labeler 10 is preferably at a distance upstream of the label applicator 24 so that when a leading edge of a document 11 triggers the loading sensor, the control circuit has enough time to activate the drive station 26 to advance the elongated strip 18 through the label applicator 24 so that the label 68*a* is peeled from the substrate 66 and retained on the front face 74 of the paddle 72.

The control circuit 122 is also operatively connected to a firing sensor 136. The firing sensor 136 senses when the leading edge of the document 11 passes the position of the firing sensor along the conveying path 28. The firing sensor 136 is positioned adjacent the conveying path 28 and opposite the paddle 72 so that when the firing sensor senses the leading edge of the document 11, the control circuit 122 actuates the actuating mechanism 94 to rotate the paddle 72 into the actuating position 92 to apply the label to the document.

Referring to FIGS. 1 and 6, the control circuit 122 is also preferably connected to a slack sensor 138 which is positioned on the surface 98 between the supply reel 14 and the guide roller 22. The slack sensor 138 is set to sense if labels 68 are in close proximity to the sensor 138. If the elongated strip 18 is not in proximity to the slack sensor 138, the control circuit 122 sends a control signal to activate a motor 142 to rotate the supply reel 14 to supply additional strip 18 so that there is slack between the supply reel 14 and the guide roller 22. Failure to provide this slack may cause tension in the elongated strip 18 between the supply reel 14 and guide roller 22 causing the substrate 66 to tear.

The control circuit 122 is also operatively connected to a drive roller motor 143 which operatively rotates a drive roller 144 making up part of the drive station 126. The drive roller 144 is mounted to a shaft 146 which extends through the supporting structure 12 and forms part of the drive station 26. The drive station 26 also includes an idler roller 148 which forms a nip 149 with the drive roller. When the substrate 66 extends upward from the label applicator 24, the substrate is wrapped about the top portion of the drive roller 144 and then extends through the nip 149 so that rotation of the drive roller causes a controlled upward movement of the substrate 66 from the label applicator 24. The drive roller motor 142 may also be attached to the take up reel 16 by a slip clutch string mechanism 152 so that rotation of the shaft 146 also causes a rotation of the take up reel 16. The rotation of the take up reel 16 gathers the substrate 66 about the take up reel after the substrate exits the drive station 26.

In operation, a supply reel 14 is mounted on the supporting structure 12 and a forward end of the elongated strip 18 wound about the supply reel is threaded over the guide roller 22, through the label applicator 24 and drive station 26, and attachingly wound about take up reel 16. The drive station 26 is then activated by a control signal generated by the control circuit 122 to advance the elongated strip 18 until the first sensor means 124 senses the leading edge of one of the labels 68 on the strip 18.

Referring to FIGS. 1, 2, 4 and 6, the associated mail sorting apparatus is then activated so that the document 11 is conveyed from an upstream station such as the reader station (not shown) in a vertical edge on edge orientation along the conveying path 28. As the document approaches the label applicator 24, the inner reach 32*a* of the upper opposite conveying belt 32 and inner reach 34*a* of the upper adjacent conveying belt engage the document 11 and transport the document along the conveying path 28 adjacent the labeler 10.

As the document 11 travels along the conveying path 28, the leading edge of the document 11 passes by and activates the loading sensor 128. Upon activation of the loading sensor 128, the control circuit 122 sends a control signal to activate the drive roller motor 142 to rotate the drive roller 144, thereby causing the strip 18 to be pulled through the label applicator 24. The strip 18 is advanced through the applicator 24 until the leading edge of the following label 68 on the strip is sensed by the first sensor means 124. When the leading edge of the following label 68 is sensed by the first sensor means, the control circuit 122 generates a control signal to de-activate the drive roller motor 142, thereby stopping the rotation of the drive roller 144 and the advancement of the strip 18. During advancement of the strip 18, a segment of the strip containing a label 68 is pulled across the lower peeler edge 58 of the peeler 56 causing the label 68 to peelingly separate from the substrate 66 in a generally vertical orientation.

As the label 68 separates from the substrate 66, the label is attracted to the front face 74 of the paddle 72 due to the suction caused by air flowing through the ports 80 into the vacuum chamber 78. Upon separation of the label 68 from the substrate 66, the label is retained against the front face 74 of the paddle 72 with the adhesive surface being exposed and facing the conveying path 28.

As the document 11 continues to be transported down the conveying path 28, the leading edge of the document passes and activates the firing sensor 136. Upon activation of the firing sensor 136, the control circuit 122 transmits a control signal to activate the actuating mechanism 94 of the applying device 71, to move the paddle 72 from the loading position to the applicating position 92. Referring also to FIG. 5, in moving the paddle 72 from the applicating position 92, the control circuit 122 first activates the second solenoid 112, which causes a small vertical drop of the activating shaft 106 and thus, the paddle 72. The small vertical drop acts to separate the remaining portion of the label 68 which may still be adhered to the substrate 66.

The control circuit 122 then transmits a control signal to activate the motor drive 96 to rotate the shaft 102 through a predetermined arc. Rotation of the shaft 102 causes a controlled pivoting of the paddle 72 through a predetermined arc so that the outer tip 72*a* of the paddle extends into the conveying path 28 as the document 11 passes along the conveying path 28 adjacent the paddle 72. When the tip 72*a* of the paddle moves into the conveying path 28, the tip presses the adhesive surface of the label 68 onto the surface of the document to attach the downstream end of the label 68 to the document 11 and the attaching force between the label and document pulls the label off the front face 74 of the paddle 72. As the document 11 continues to travel down the conveying path 28, the outer tip 72*a* of the paddle acts in a swiping or a scraping motion along the non-adhesive surface of the label to smoothly apply the label to the face of the document.

Referring to FIG. 2, to support the side of the document 11 opposite the applicator 71 and to insure that the contact force between the paddle 72 and document 11 is sufficient to cause the adhesive surface of the label 68 to attach to the surface of the document, the labeler 10 includes a backing roller assembly 154. The backing roller assembly 154 includes an elongated bracket 156 which is pivotally mounted to a stub shaft 158 attached to the surface 98. A backing roller 160 having a generally vertical axis of rotation is rotatably mounted to the bracket 156. The backing roller assembly 154 is positioned so that the circumferential edge of the backing roller 160 is in close proximity to the inner reach 34*a* of the opposing lower conveying belt 34 at a point along the conveying path 28 opposite the point where the outer tip 72*a* of the paddle 72 contacts the document.

When the outer tip 72*a* of the paddle 72 contacts the document 11, the contact force may cause the lower section of the document to be forced away from the paddle 72. If the document 11 is forced in a direction away from the paddle 72, the backing roller 160 contacts the inner reach 34*a* of the lower belt 34 to support the opposite side surface of the document 11. The backing roller assembly 154 includes a biasing means 162 so that if during the passage of the document 11, the contact force between the inner reach 34*a* of the lower conveying belt 34 and the backing roller 160 causes the bracket 156 to rotate about the stub shaft 158, and the biasing means 162 causes the backup roller 160 to apply a force against the lower conveying belt 34. The biasing means 162 also returns the backing roller 160 to the initial contact position after the document 11 has traveled past. The biasing means 162 is preferably a spring 163 which is attached to the end 164 of the bracket opposite the backing roller 160. The other end of the spring may be attached to the surface 98 or other structure.

There may be some instances where the scraping contact between the outer tip 72*a* of the paddle 72 and the document 11 may be inadequate to force the entire adhesive surface of the label to attach to the document. This may occur for example, if the document has an irregular thickness configuration at the point where the label 68 is attached. To force any loose areas into contact with the document 11, the applicator 24 includes a high speed air jet 170. The air jet 170 is located horizontally down-stream of and in close proximity to the tip 72*a* of the paddle 72. The air jet 170 directs a stream of air normal to the conveying path 28 so that as the document moves past the tip 72*a* of the paddle 72, the air jet stream impacts the label 68 to force any unattached surface areas into attaching contact with the document 11. To supply pressurized air to the air jet, a hose 172 is attached to the air jet. The hose 172 is in turn attached to a source of pressurized air comprising a compressor or the like (not shown).

Once the label 68 is applied, the document 11 may be transported down the conveying path 28 to a bar coding apparatus (not shown) or sorting apparatus.

A specific embodiment of the novel high speed labeler according to the present invention has been described for the purposes of illustrating the manner in which the invention may be made and used. It should be understood that implementation of other variations and modifications of the invention in its various aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

We claim:

1. A labeling assembly for applying labels releasably carried on a substrate to a document, the assembly comprising:

means for transporting the document horizontally in a generally vertical end on end orientation down a horizontally extending conveying path;

means for peeling the label from the substrate in a vertical direction and orienting the peeled label in a generally vertical orientation;

means for releasably retaining the peeled label on said assembly and moving the label in a horizontal plane to apply the label to the document, said applying means including a paddle having a front surface, means for releasably retaining the label on said front surface, and means for pivoting the paddle in a horizontal plane about a vertically extending axis to initially force an end of the retained label into contact with a first side of the horizontally moving document wherein a downstream end of the retained label initially contacts and adheres to the document.

2. The assembly of claim 1 wherein said horizontally pivoting paddle includes means for scrapingly and continually pressing the label onto the document as the document is moving down the conveying path.

3. The assembly of claim 1 further including means for directing a stream of air against the label after the label has been attached to the document by the paddle.

4. The assembly of claim 1 wherein the retaining means includes a plurality of suction ports formed in said paddle, the ports communicating with said front face of said paddle and a suction force applied to said suction ports.

5. The assembly of claim 1 wherein said pivoting means includes means for lowering the paddle in a vertical plane prior to the contact between the retained label and the document to assist in peeling the label from the substrate.

6. The assembly of claim 1 further including control system means operatively connected to the pivoting means for activating the pivoting means when the document passes a first predetermined location along the conveying path.

7. The assembly of claim 6 wherein said peeling means includes means for pulling the substrate over a peeling edge to peelingly remove a label from the substrate, the peeling edge being located in close proximity to said retaining means, said control system means being operatively connected to said pulling means and including means for activating said pulling means when the document passes a predetermined location along the conveying path.

8. The assembly of claim 1 further including a backing means for applying a supporting force against a second side of the document opposite the first side when said second side of the document moves outward from said conveying path.

9. A labeling assembly for applying labels releasably carried on an elongated strip to a plurality of horizontally moving documents, the assembly comprising:

means for transporting the documents horizontally in a generally vertical end on end orientation down a conveying path;

means for pulling the elongated strip over a peeling means for sequentially peeling labels from the substrate in a vertical direction and orienting each peeled label in a generally vertical orientation;

means for pivoting each peeled label in a horizontal plane to extend a downstream end of the peeled label into the conveying path to contact the document being transported down the conveying path;

means for activating said pivoting means when the document passes a predetermined location along the conveying path.

10. The assembly of claim 9 wherein said peeling means includes a peeling bar having a lower peeling edge generally aligned with said pivoting means, said pulling means includes a drive roller and an idler roller forming a nip, the elongated strip extending from said peeling bar through said nip.

11. The assembly of claim 10 further including means for controllably providing the elongated strip to said peeling means, said providing means including a rolled supply of the elongated strip extending from said supply about said idler roller to said peeling edge, said providing means also including means for maintaining a desired amount of slack between said supply and said idler roller.

12. A labeling assembly for applying labels releasably carried on a substrate to a document, the assembly comprising:

means for transporting the document horizontally in a generally vertical end on end orientation down a horizontally disposed conveying path;

a peeler bar disposed along the conveying path and forming a peeling edge to peel the label from the substrate in a vertical direction and orient the peeled label in a generally vertical orientation;

a paddle having a front surface and pivotal in a horizontal plane from a first position whereby the front surface is generally aligned with the peeler edge to a second position whereby an outer tip of the paddle extends into the document path so that said outer tip contacts the transported document to initially apply a downstream end of the label to the document, said paddle including means for releasably retaining the peeled label on said front surface.

13. The assembly of claim 12 wherein when said paddle is pivoted in a horizontal plane into said second position, said front surface is angled relative to said conveying path and said outer tip scrapingly and continually presses the label onto the document as the document is transported down said path.

14. The assembly of claim 12 further including an air jet along said conveying path downstream of said paddle to direct a stream of air against the label after the label has been attached to the document by said paddle.

15. The assembly of claim 12 wherein said retaining means includes a plurality of suction ports formed in said paddle, the ports communicating with said front face of said paddle.

16. The assembly of claim 12 wherein said front surface is disposed vertically below said peeler bar when said paddle is in said first position.

17. A method for applying labels releasably carried on a substrate to a document, the method comprising the steps of:

transporting the document in a generally vertical end on end orientation down a horizontally extending conveying path;

peeling the label from the substrate in a vertical direction, orienting the peeled label in a generally vertical orientation and releasably retaining the peeled label on a front surface of a horizontally pivoting paddle, said peeling step including drawing the substrate vertically across a peeling edge;

pivoting said paddle and said label in a horizontal direction from a first position whereby said front surface is generally aligned with said peeler edge to a second position whereby an outer tip of the paddle extends into the document path so that said outer tip initially contacts the transported document; and applying the label to the document.

18. The method of claim 17 wherein said applying step includes scrapingly applying the label to a surface of the transported document, said scrapingly applying step including angling said front surface relative to said conveying path and initially applying a downstream end of said label to said document.

19. The method of claim 17 further including directing a jet of air against the applied label downstream of said outer tip.

* * * * *